US008415595B2

(12) United States Patent
Chirico et al.

(10) Patent No.: US 8,415,595 B2
(45) Date of Patent: Apr. 9, 2013

(54) SYSTEM, APPARATUS, AND METHOD FOR INDUCTION HEATING USING FLUX-BALANCED INDUCTION HEATING WORKCOIL

(75) Inventors: Salvatore Chirico, Port Moody (CA); Nicholas Dohmeier, North Vancouver (CA); Jonathan Crawford, Vancouver (CA)

(73) Assignee: Honeywell International Inc., Morristown, NJ (US)

( * ) Notice: Subject to any disclaimer, the term of this patent is extended or adjusted under 35 U.S.C. 154(b) by 1311 days.

(21) Appl. No.: 12/103,173

(22) Filed: Apr. 15, 2008

(65) Prior Publication Data

US 2009/0255925 A1 Oct. 15, 2009

(51) Int. Cl.
*H05B 6/36* (2006.01)

(52) U.S. Cl.
USPC ..... 219/674; 219/677

(58) Field of Classification Search ..... 100/47, 100/92, 93 RP, 153, 168, 169, 176, 330, 332, 100/917; 219/10.41, 10.49 A, 10.49 R, 10.61 R, 219/10.61 A, 10.57, 10.77, 10.75, 10.79, 219/10.71, 10.43, 469, 470, 471; 336/182, 336/183; 162/198, 199, 206, 207, 359, 360.1, 162/305

See application file for complete search history.

(56) References Cited

U.S. PATENT DOCUMENTS 2,414,990 A * 1/1947 Weed ..... 336/60
3,413,915 A * 12/1968 Goodwin et al. ..... 100/169
4,286,515 A * 9/1981 Baumann et al. ..... 100/233
4,384,514 A 5/1983 Larive et al.
4,614,565 A 9/1986 Riihinen
4,621,177 A * 11/1986 Pulkowski et al. ..... 219/619
4,631,794 A 12/1986 Riihinen
4,675,487 A * 6/1987 Verkasalo ..... 219/619
4,704,191 A * 11/1987 Wedel ..... 162/358.3
4,889,598 A 12/1989 Niskanen
4,948,466 A 8/1990 Jaakkola (Continued)

FOREIGN PATENT DOCUMENTS

EP 0059421 A2 5/1984
EP 0337973 B2 8/1995

(Continued)

OTHER PUBLICATIONS

International Search Report and Written Opinion for PCT/US2009/038855 mailed Oct. 30, 2009.

(Continued)

*Primary Examiner* — Henry Yuen
*Assistant Examiner* — Thien S Tran

(57) ABSTRACT

An apparatus includes one or more magnetic cores collectively having an inner leg located between two outer legs. The legs are coupled to one or more connecting portions. The apparatus also includes one or more conductive coils wound around the inner leg. The one or more magnetic cores and the one or more conductive coils are configured to generate substantially balanced magnetic fluxes when the conductive coil is energized. Also, the one or more magnetic cores and the one or more conductive coils are configured so that heat created by currents induced in the roll by the magnetic fluxes produces a steady state thermal profile on a surface of the roll. The steady state thermal profile has one peak that falls within a control zone associated with the roll. The one or more magnetic cores could include a single magnetic core or multiple magnetic cores.

20 Claims, 4 Drawing Sheets

U.S. PATENT DOCUMENTS

| | | | | |
|---|---|---|---|---|
| 4,948,467 | A | 8/1990 | Creagan et al. | |
| 5,151,576 | A | 9/1992 | Zaoralek | |
| 6,200,426 | B1 | 3/2001 | Graf et al. | |
| 6,349,637 | B1 * | 2/2002 | Molteni | 100/168 |
| 6,657,529 | B1 * | 12/2003 | Albach | 336/182 |
| 6,900,420 | B2 * | 5/2005 | Markegård et al. | 219/632 |
| 7,022,951 | B2 | 4/2006 | Larive et al. | |
| 7,076,198 | B2 | 7/2006 | Kim et al. | |
| 7,146,238 | B2 | 12/2006 | Burma | |
| 2002/0020144 | A1 * | 2/2002 | Sarles et al. | 53/329 |
| 2002/0121353 | A1 | 9/2002 | Saynavajarvi | |
| 2002/0179269 | A1 | 12/2002 | Klerelid | |
| 2004/0261965 | A1 | 12/2004 | Burma | |
| 2007/0248389 | A1 | 10/2007 | Asakura et al. | |

FOREIGN PATENT DOCUMENTS

| | | | |
|---|---|---|---|
| EP | 1 537 273 | B1 | 4/2006 |
| EP | 0337973 | B2 | 4/2006 |
| JP | 268526 | B2 | 11/1997 |
| JP | 2678526 | B2 | 11/1997 |
| JP | 3105646 | B2 | 11/2000 |
| JP | 2001-303470 | A | 10/2001 |
| WO | WO0005065 | | 2/2000 |

OTHER PUBLICATIONS

International Search Report and Written Opinion for PCT/US2009/038892 mailed Nov. 25, 2009.

"Calcoil, Enhancing Finishing and Caliper Profile Control", Honeywell, 2002, 11 pages.

Roland Schigas et al., "New Induction Heating Technology", 4 pages.

"Induction Frequently Asked Questions", Radyne Corporation, 2007, 3 pages.

Salvatore Chirico et al., "System and Method for Reducing Current Exiting a Roll Through Its Bearings", U.S. Appl. No. 12/103,195, filed Apr. 15, 2008.

Salvatore Chirico et al., "System and Method for Reducing Current Exiting a Roll Through Its Bearings Using Balanced Magnetic Flux Vectors in Induction Heating Applications", U.S. Appl. No. 12/103,239, filed Apr. 15, 2008.

"Diagram of Honeywell Calcoil CW product", sold since appox. 1999, 1 page.

Notification of Transmittal of the International Search Report and teh Written Opinion of the International Searching Authority, or the Declaration dated Aug. 17, 2010 in connection with International Petent Application No. PCT/US2010/022343.

International Search Report and Written Opinion for PCT/US2009/038869 mailed Sep. 29, 2009.

Office Action issued by the United States Patent and Trademark Office on Dec. 19, 2011 in connection with U.S. Appl. No. 12/368,244.

Supplementary European Search Report dated Oct. 18, 2012 in connection with European Patent Application No. EP 10 73 8983.

* cited by examiner

100

SYSTEM, APPARATUS, AND METHOD FOR INDUCTION HEATING USING FLUX-BALANCED INDUCTION HEATING WORKCOIL

CROSS-REFERENCE TO RELATED APPLICATIONS

Ser. No. 12/103,195 entitled "SYSTEM AND METHOD FOR REDUCING CURRENT EXITING A ROLL THROUGH ITS BEARINGS" filed on Apr. 15, 2008; and Ser. No. 12/103,239 entitled "SYSTEM AND METHOD FOR REDUCING CURRENT EXITING A ROLL THROUGH ITS BEARINGS USING BALANCED MAGNETIC FLUX VECTORS IN INDUCTION HEATING APPLICATIONS" filed on Apr. 15, 2008.

TECHNICAL FIELD

This disclosure relates generally to paper production systems and other systems using rolls. More specifically, this disclosure relates to a system, apparatus, and method for induction heating using flux-balanced induction heating workcoil(s).

BACKGROUND

Paper production systems and other types of continuous web systems often include a number of large rotating rolls. For example, sets of counter-rotating rolls can be used in a paper production system to compress a paper sheet being formed. The amount of compression provided by the counter-rotating rolls is often controlled through the use of induction heating devices. The induction heating devices create currents in a roll, which heats the surface of the roll. The heat or lack thereof causes the roll to expand and contract, which controls the amount of compression applied to the paper sheet being formed.

SUMMARY

This disclosure provides a system, apparatus, and method for induction heating using flux-balanced induction heating workcoil(s).

In a first embodiment, an apparatus includes one or more magnetic cores collectively having an inner leg located between two outer legs. The legs are coupled to one or more connecting portions. The apparatus also includes one or more conductive coils wound around the inner leg. The one or more magnetic cores and the one or more conductive coils are configured to generate substantially balanced magnetic fluxes when the one or more conductive coils are energized. Also, the one or more magnetic cores and the one or more conductive coils are configured so that heat created by currents induced in the roll by the magnetic fluxes produces a steady state thermal profile on a surface of the roll. The steady state thermal profile has one peak that falls within a control zone associated with the roll.

In particular embodiments, substantially all of the magnetic fluxes are generated within the control zone associated with the roll.

In other particular embodiments, the one or more magnetic cores represent a single magnetic core. The single magnetic core includes a single connecting portion coupling the inner and outer legs.

In yet other particular embodiments, the one or more magnetic cores represent two magnetic cores. Each magnetic core includes two legs, and the inner leg includes one leg from each of the magnetic cores.

In still other particular embodiments, the apparatus further includes a second coil wound around the one or more conductive coils and configured to cool the one or more magnetic cores and/or the one or more conductive coils.

In additional particular embodiments, the apparatus also includes a heatsink attached to the core and configured to release thermal energy generated when the one or more conductive coils are energized. The apparatus could further include a thermal shunt configured to provide thermal energy from the one or more magnetic cores and/or the one or more conductive coils to the heatsink.

In a second embodiment, a system includes a roll formed from a conductive material and configured to rotate about an axis. The system also includes an induction heating workcoil having one or more magnetic cores and one or more conductive coils. The one or more magnetic cores collectively include an inner leg located between two outer legs, and the legs are coupled to one or more connecting portions. The one or more conductive coils are wound around the inner leg. The one or more magnetic cores and the one or more conductive coils are configured to generate magnetic fluxes within the roll, where the magnetic fluxes when spatially summed have a substantially null instantaneous magnetic flux vector.

In a third embodiment, a method includes placing an induction heating workcoil in proximity with a roll. The induction heating workcoil includes one or more magnetic cores and one or more conductive coils. The one or more magnetic cores collectively include an inner leg located between two outer legs, and the one or more conductive coils are wound around the inner leg. The roll is configured to rotate about an axis. The method also includes generating currents within the roll, where the currents collectively have a substantially null instantaneous current vector and flow substantially parallel to the axis of the roll.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 1 through 5, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1:
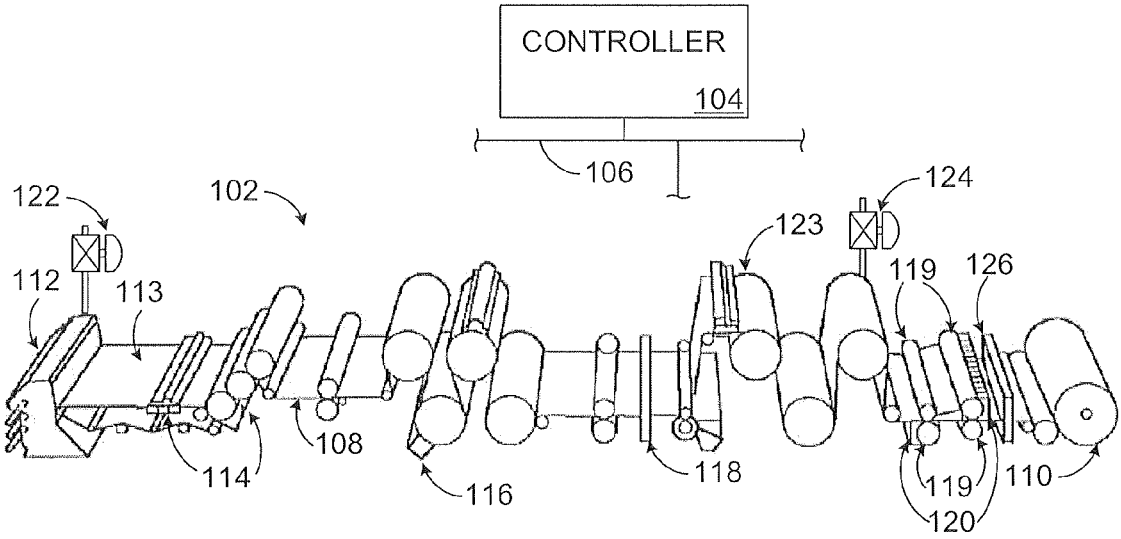
FIG. 1 illustrates an example paper production system according to this disclosure.

FIG. 1 illustrates an example paper production system 100 according to this disclosure. The embodiment of the paper production system 100 shown in FIG. 1 is for illustration only. Other embodiments of the paper production system 100 may be used without departing from the scope of this disclosure.

As shown in FIG. 1, the paper production system 100 includes a paper machine 102, a controller 104, and a network 106. The paper machine 102 includes various components used to produce a paper product. In this example, the various components may be used to produce a continuous paper web or sheet 108 collected at a reel 110. The controller 104 monitors and controls the operation of the system 100, which may help to maintain or increase the quality of the paper sheet 108 produced by the paper machine 102.

In this example, the paper machine 102 includes a headbox 112, which distributes a pulp suspension uniformly across the machine onto a continuous moving wire screen or mesh 113. The pulp suspension entering the headbox 112 may contain, for example, 0.2-3% wood fibers, fillers, and/or other materials, with the remainder of the suspension being water. The headbox 112 may include an array of dilution actuators, which distributes dilution water or a suspension of different composition into the pulp suspension across the sheet. The dilution water may be used to help ensure that the resulting paper sheet 108 has a more uniform basis weight or more uniform composition across the sheet 108. The headbox 112 may also include an array of slice lip actuators, which controls a slice opening across the machine from which the pulp suspension exits the headbox 112 onto the moving wire screen or mesh 113. The array of slice lip actuators may also be used to control the basis weight of the paper or the distribution of fiber orientation angles of the paper across the sheet 108.

An array of drainage elements 114, such as vacuum boxes, removes as much water as possible. An array of steam actuators 116 produces hot steam that penetrates the paper sheet 108 and releases the latent heat of the steam into the paper sheet 108, thereby increasing the temperature of the paper sheet 108 in sections across the sheet. The increase in temperature may allow for easier removal of additional water from the paper sheet 108. An array of rewet shower actuators 118 adds small droplets of water (which may be air atomized) onto one or both surfaces of the paper sheet 108. The array of rewet shower actuators 118 may be used to control the moisture profile of the paper sheet 108, reduce or prevent overdrying of the paper sheet 108, correct any dry streaks in the paper sheet 108, or enhance the effect of subsequent surface treatments (such as calendering).

The paper sheet 108 is then often passed through a calender having several nips of counter-rotating rolls 119. Arrays of induction heating workcoils 120 heat the surfaces of various ones of these rolls 119. As each roll surface locally heats up, the roll diameter is locally expanded and hence increases nip pressure, which in turn locally compresses the paper sheet 108 and transfers heat energy to it. The arrays of induction heating workcoils 120 may therefore be used to control the caliper (thickness) profile of the paper sheet 108. The nips of a calender may also be equipped with other actuator arrays, such as arrays of air showers or steam showers, which may be used to control the gloss profile or smoothness profile of the paper sheet.

Two additional actuators 122-124 are shown in FIG. 1. A thick stock flow actuator 122 controls the consistency of the incoming stock received at the headbox 112. A steam flow actuator 124 controls the amount of heat transferred to the paper sheet 108 from drying cylinders 123. The actuators 122-124 could, for example, represent valves controlling the flow of stock and steam, respectively. These actuators may be used for controlling the dry weight and moisture of the paper sheet 108. Additional components could be used to further process the paper sheet 108, such as a supercalender (for improving the paper sheet's thickness, smoothness, and gloss) or one or more coating stations (each applying a layer of coatant to a surface of the paper to improve the smoothness and printability of the paper sheet). Similarly, additional flow actuators may be used to control the proportions of different types of pulp and filler material in the thick stock and to control the amounts of various additives (such as retention aid or dyes) that are mixed into the stock.

This represents a brief description of one type of paper machine 102 that may be used to produce a paper product. Additional details regarding this type of paper machine 102 are well-known in the art and are not needed for an understanding of this disclosure. Also, this represents one specific type of paper machine 102 that may be used in the system 100. Other machines or devices could be used that include any other or additional components for producing a paper product. In addition, this disclosure is not limited to use with systems for producing paper sheets and could be used with systems that process the paper sheets or with systems that produce or process other products or materials in continuous webs (such as plastic sheets or thin metal films like aluminum foils).

In order to control the paper-making process, one or more properties of the paper sheet 108 may be continuously or repeatedly measured. The sheet properties can be measured at one or various stages in the manufacturing process. This information may then be used to adjust the paper machine 102, such as by adjusting various actuators within the paper machine 102. This may help to compensate for any variations of the sheet properties from desired targets, which may help to ensure the quality of the sheet 108.

As shown in FIG. 1, the paper machine 102 includes a scanner 126, which may include one or more sensors. The scanner 126 is capable of scanning the paper sheet 108 and measuring one or more characteristics of the paper sheet 108. For example, the scanner 126 could include sensors for measuring the weight, moisture, caliper (thickness), gloss, color, smoothness, or any other or additional characteristics of the paper sheet 108. The scanner 126 includes any suitable structure or structures for measuring or detecting one or more characteristics of the paper sheet 108, such as sets or arrays of sensors.

The controller 104 receives measurement data from the scanner 126 and uses the data to control the system 100. For example, the controller 104 may use the measurement data to adjust the various actuators in the paper machine 102 so that the paper sheet 108 has properties at or near desired properties. The controller 104 includes any hardware, software, firmware, or combination thereof for controlling the operation of at least part of the system 100. Also, while one controller is shown here, multiple controllers could be used to control the paper machine 102.

The network 106 is coupled to the controller 104 and various components of the system 100 (such as actuators and scanners). The network 106 facilitates communication between components of system 100. The network 106 represents any suitable network or combination of networks facilitating communication between components in the system 100. The network 106 could, for example, represent an Ethernet network, an electrical signal network (such as a HART or FOUNDATION FIELDBUS network), a pneumatic control signal network, or any other or additional network(s).

In one aspect of operation, the induction heating workcoils 120 may operate by generating currents in the surface of one or more of the rolls 119. In some conventional systems, the currents created in a roll can exit the roll through its bearings. These so-called "bearing currents" (also called "shaft currents") can lead to premature wear and damage to the bearings supporting the roll. For example, the bearings can sometimes separate by small distances, and the currents flowing through the bearings can create sparks that pit or otherwise damage the bearings. Because of this, the bearings need to be replaced sooner or more often than desired. This leads to down time of the system 100 and monetary losses. While insulated bearings are available and could be used, the insulated bearings are often quite expensive compared to conventional bearings. In accordance with this disclosure, the induction heating workcoils 120 are designed so that a reduced or minimal amount of current flows out of the rolls 119 through their bearings. This is done by balancing the magnetic fluxes created by each of the induction heating workcoils 120 within the rolls 119. This leads to reduced wear on and damage to the bearings, resulting in increased usage and fewer replacements. Additional details are provided below.

Although FIG. 1 illustrates one example of a paper production system 100, various changes may be made to FIG. 1. For example, other systems could be used to produce paper sheets or other products. Also, while shown as including a single paper machine 102 with various components and a single controller 104, the production system 100 could include any number of paper machines or other production machinery having any suitable structure, and the system 100 could include any number of controllers. In addition, FIG. 1 illustrates one operational environment in which induction heating workcoils 120 or other workcoils can be used to reduce currents flowing through bearings of one or more rolls. This functionality could be used in any other suitable system.

Figure 2:
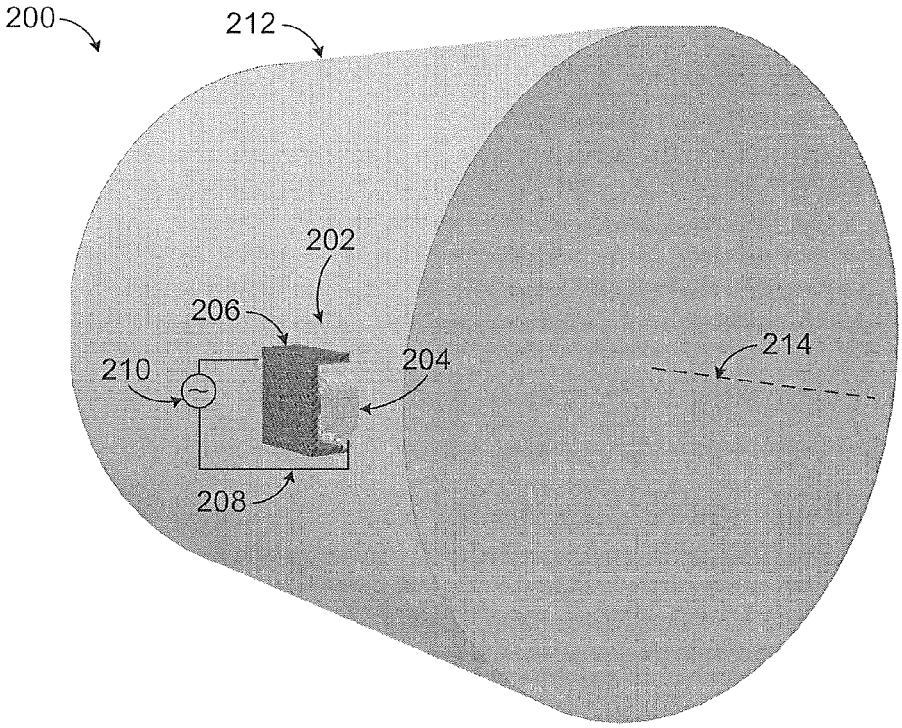
FIG. 2 illustrates an example orientation of an induction heating workcoil with respect to a roll according to this disclosure.

FIG. 2 illustrates an example orientation 200 of an induction heating workcoil with respect to a roll according to this disclosure. As shown in FIG. 2, an induction heating workcoil 202 includes a coil 204 and a core 206. The coil 204 generally represents any suitable conductive material(s) wound in a coil or otherwise wrapped around at least a portion of the core 206. The coil 204 could, for example, represent Litz wire or other conductive wire wrapped around the core 206. The core 206 generally represents a structure that can direct or focus a magnetic field created by current flowing through the coil 204. The core 206 could, for example, represent ferrite. Terminal wires 208 couple the coil 204 to a power source 210. A combination of one or more workcoils and one or more power sources forms an induction heating actuator. The power source 210 generally represents a source of electrical energy flowing through the coil 204. The power source 210 could, for example, represent an alternating current (AC) source that operates at a specified frequency (such as 16 kHz or other frequency). The AC signals flow through the coil 204 and produce magnetic fluxes.

In this example, the induction heating workcoil 202 is placed in proximity to a roll 212, which rotates about an axis 214. Magnetic fluxes are produced in the roll 212 by the induction heating workcoil 202 and produce currents in the surface of the roll 212, heating the surface of the roll 212. In this example, the magnetic fluxes travel substantially perpendicular to the axis 214 of the roll 212, and the currents generally flow in a direction orthogonal (perpendicular) to the magnetic fluxes. The production of the currents can be adjusted to control the amount of heating of the roll's surface, which also controls the amount of compression applied by the roll 212 to a paper sheet or other product.

In this embodiment, the induction heating workcoil 202 represents a balanced workcoil, meaning the individual workcoil 202 creates magnetic fluxes that effectively cancel each other out to produce a substantially zero sum spatial vector. This is opposed to an unbalanced workcoil, which would produce magnetic fluxes that have an appreciably non-zero sum spatial vector. In this embodiment, the balanced induction heating workcoil 202 individually produces a substantially null instantaneous current vector, meaning little or no current flows parallel to the axis 214 and out of the roll 212 through its bearings at its ends. This can be true regardless of how the induction heating workcoil 202 is oriented towards the roll 212 (regardless of how the surface of the workcoil 202 facing the roll 212 is rotated). As noted below, multiple induction heating workcoils could be used, such as in different areas or zones of the roll 212. In general, any combination of induction heating workcoils can be used as long as the magnetic flux vectors produced in the roll 212 when spatially summed produce a substantially null instantaneous magnetic flux vector.

Figure 3A:
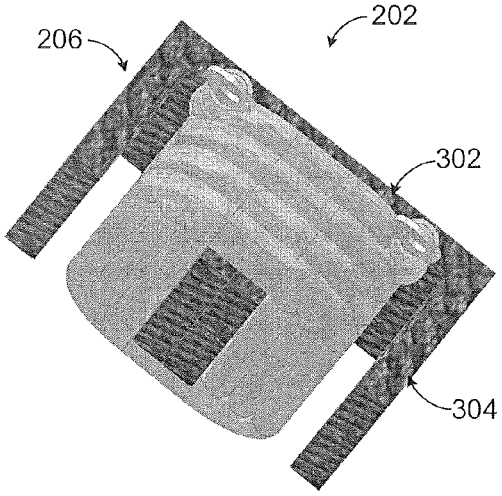
FIGS. 3A through 3I illustrate example induction heating workcoils according to this disclosure.
Figure 3B:
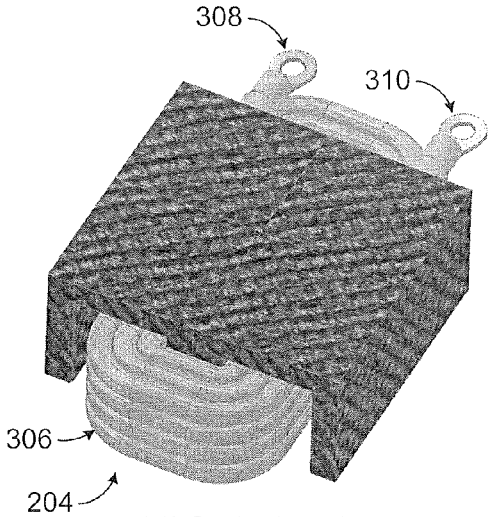

FIGS. 3A through 3I illustrate example induction heating workcoils according to this disclosure. FIGS. 3A and 3B illustrate the induction heating workcoil 202 from FIG. 2 in more detail. As shown here, the core 206 includes a connecting portion 302 and three legs 304 extending from the connecting portion 304. The three legs 304 generally span the width of the connecting portion 302 and extend away from the connecting portion 302. In this configuration, the core 206 has a substantially E-shaped cross-section (where the cross-section is taken using a plane passing through the connecting portion 302 and all three legs 304). Note that the connecting portion 302 and the legs 304 could each have any suitable size and shape. For instance, while shown as being square, the connecting portion 302 of the core 206 could have another shape, such as rectangular. Also, the legs 304 could extend any suitable distance away from the connecting portion 302, and the distance need not be the same for all legs 304. In addition, the inner leg 304 is shown here as being wider, although the legs 304 of the core 206 could have any suitable equal or non-equal shape(s).

In this example, the coil 204 includes a wire 306 that is wound around the inner leg 304 of the core 206. The wire 306 has terminals 308-310 at its ends, and the terminals 308-310 facilitate coupling of the coil 204 to an external component (such as to the power source 210 via terminal wires 208). Here, the wire 306 is wound around the inner leg 304 of the core 206 in three layers. However, the wire 306 could have any suitable number of turns or layers and be wound in any suitable direction. Note that the terms "inner" and "outer" here (referring to the legs 304) denote relative positions of the legs and do not necessarily denote their positions on the connecting portion.

Figure 3C:
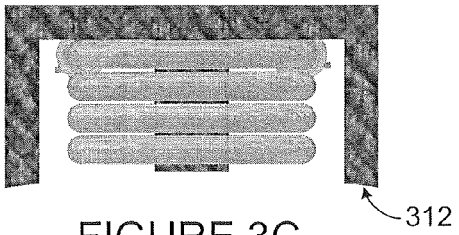

FIG. 3C illustrates how the legs 304 of the core 206 could have different shapes or sizes. In this example, the inner leg is shorter than the two outer legs. Also, the outer legs have chamfered or angled ends 312. This allows the legs 304 to more closely follow the curved surface of the roll 212, so the induction heating workcoil 202 could be placed closer to the roll 212.

Figure 3D:
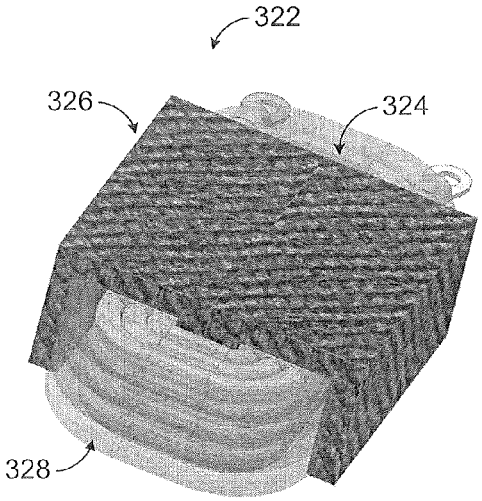

Overheating of a workcoil may be a problem in some situations. FIG. 3D illustrates a workcoil 322 with a coil 324 and a core 326 in a similar configuration as shown in FIGS. 3A-3B. The workcoil 322 also includes a second coil 328 wound around the first coil 324. The second coil 328 in this example represents tubing or other hollow structure through which water or other fluid or material may pass. This allows thermal energy to be moved away from the coil 324 and/or the core 326. In this way, a cooling material can travel around the coil 324 and possibly on the open face of the workcoil 322 to help cool the workcoil 322 during operation. The second coil 328 could be formed from any suitable material(s), such as a non-ferromagnetic, non-metallic material like PTFE.

Figure 3E:
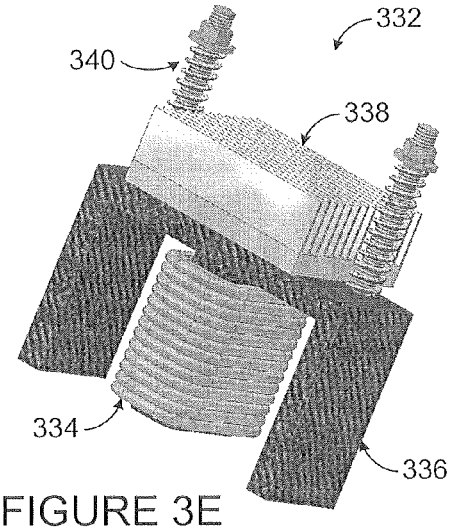

FIG. 3E illustrates a workcoil 332 with a coil 334 and a core 336. The workcoil 332 also includes a heatsink 338 attached to or otherwise associated with the back surface of the core 336. The heatsink 338 in this example includes a finned structure that can remove thermal energy from the core 336. The thermal energy is then radiated into the surrounding environment by the heatsink 338. The heatsink 338 could be formed from any suitable material(s) and have any suitable size and shape. In addition, the workcoil 332 in this example includes spring mounts 340 that can couple the workcoil 332 to a support frame or other support structure. The spring mounts 340 can help to reduce or eliminate shock damage, such as when a roll moves suddenly out of its normal operating position.

Figure 3F:
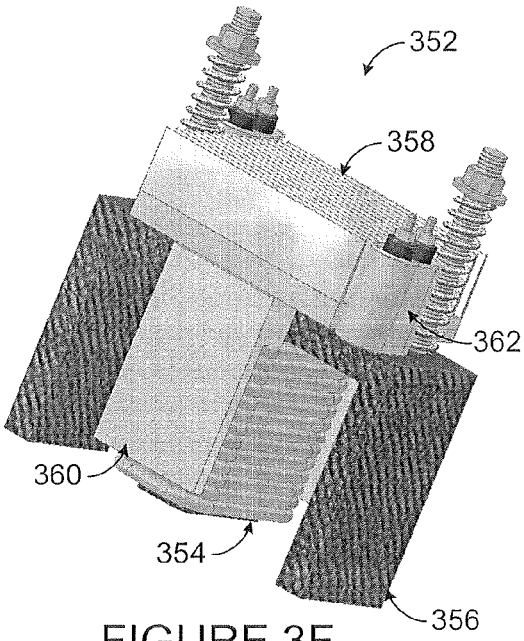

FIG. 3F illustrates a workcoil 352 with a coil 354 and a core 356. The workcoil 352 also includes a heatsink 358 and a thermal shunt 360. The heatsink 358 removes thermal energy from the coil 354 and/or the core 356, and the thermal shunt 360 transfers heat from the coil 354 and/or the core 356 to the heatsink 358. The thermal shunt 360 could be formed from any suitable material(s), such as a non-metallic, non-ferromagnetic material (like aluminum nitride ceramics). In this example, the workcoil 352 also includes a portion of control/power electronics that has been relocated to the workcoil 352. In particular, the workcoil 352 includes two capacitors 362, such as resonant capacitors. Note that these capacitors 362 could be placed in any suitable location(s), such as on or in the workcoil 352, in its enclosure, or adjacent to the heatsink 358. Placing the capacitors 362 on or near the workcoil 352 could reduce the size of the conductors (the terminal wires) coupling the coil 354 to a power source. Although not shown, detachable conductive connectors could be used to couple the workcoil 352 to its power/control electronics.

Figure 3G:
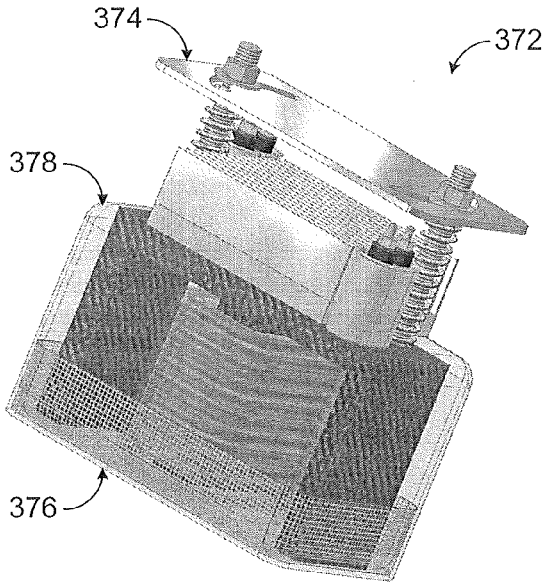

FIG. 3G illustrates a workcoil 372 with various ones of the features shown in FIGS. 3A-3F. The workcoil 372 also includes a mounting plate 374 with curved slots through which spring mounts or other mounts from the workcoil 372 can be inserted. The curved slots enable adjustment of the workcoil's position or orientation (such as by enabling rotation of the workcoil). This may allow an operator to adjust or optimize the magnetic flux path within a roll to provide a desired thermal expansion response. Among other things, this could enable improved or optimal paper caliper control. The workcoil 372 also includes a reinforcing material 376 and/or a protective enclosure 378. The reinforcing material 376 is placed around ends of the core and helps strengthen or reinforce the core, such as to help reduce damage from shock. The reinforcing material 376 could be formed from any suitable material(s), such as Kevlar fabric or reinforcing members or framing. The protective enclosure 378 similarly protects and reinforces the core and coil of the workcoil 372. The protective enclosure 378 could be formed from any suitable material(s), such as an epoxy potting or encapsulation, a varnish coating, or a sealed container. In addition, the reinforcing material 376 and/or the protective enclosure 378 could include filler powders or other material(s) that can increase conductivity of thermal energy away from the core and coil and towards a heatsink.

Figure 3H:
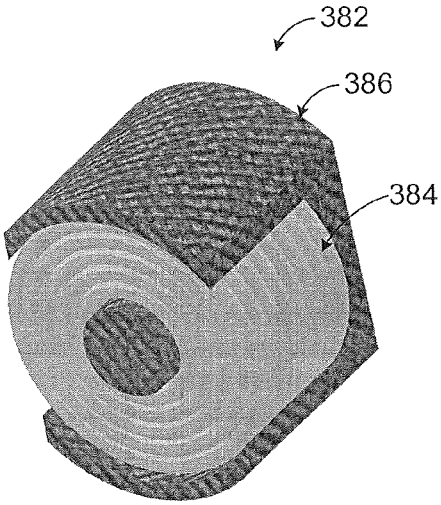
Figure 3I:
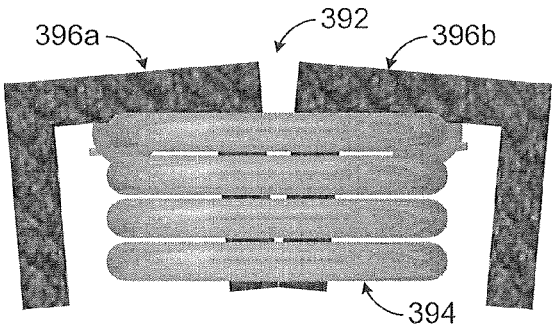

FIGS. 3H and 3I illustrate other possible induction heating workcoils with modified E-shaped cross sections. In FIG. 3H, an induction heating workcoil 382 includes a coil 384 and a core 386. The core 386 includes a connecting portion and three legs (an inner leg that is cylindrical in shape and two outer legs that are curved). Again, the core 386 has an E-shaped cross-section (when taken using a plane passing through the connecting portion and all three legs of the core 386). It may be noted that the size and shape of the connecting portion and each leg is for illustration only. The coil 384 is wound around the inner leg of the core 386. Here, the coil 384 is wound in five layers around the inner leg, although the coil 384 could have any suitable number of turns or layers.

In FIG. 3I, an induction heating workcoil 392 includes a coil 394 and two cores 396*a*-396*b*. Each of the cores 396*a*-396*b* includes two legs separated by a connecting portion. Also, the cores 396*a*-396*b* are placed next to each other and could possibly be coupled together (such as using a hinge). In this way, legs from two different cores 396*a*-396*b* can collectively form a larger inner leg in an E-shaped cross-section (when taken using a plane passing through the connecting portions and legs of the cores 396*a*-396*b*). It may be noted that the size and shape of each core and each leg is for illustration only. The coil 394 is wound around the two adjacent legs of the cores 396*a*-396*b*. The coil 394 could have any suitable number of turns or layers.

The induction heating workcoils shown in FIGS. 3A through 3I are balanced workcoils, meaning each produces magnetic fluxes that effectively cancel each other out to produce a substantially zero sum spatial vector. This results in a substantially null instantaneous current vector, so a reduced or minimal amount of current may flow parallel to the axis 214 of the roll 212. This can help to reduce or minimize bearing currents through the bearings of the roll 212.

As can be seen here, various induction heating workcoils can be designed to have an E-shaped cross-section. Each of these induction heating workcoils includes at least three legs (in one or multiple cores), where a central or inner leg is located between two outer or other legs. An E-shaped cross-section may generally include three legs projecting from a connection portion that couples the legs (regardless of whether the legs project at the same angle).

The E-shaped cores here could have any suitable size. For example, a core could be 150 millimeters in length, 93.5 millimeters in height, and 50 millimeters in width. The outer legs could be 12.5 millimeters thick and extend 81 millimeters out from a connecting portion.

Any of these workcoils can generate magnetic fluxes in a roll. When oriented properly, substantially all of the magnetic fluxes remains within a single control zone of the roll. Also, only one thermal peak is present in the single control zone. A "control zone" generally represents the spatial area between two cross-sections of a roll (both taken normal to the roll axis), where a workcoil is associated with the control zone and is regulated to optimize or control one or more web properties (such as moisture, gloss, caliper, and/or temperature) in a portion of a web material contacted by the roll. The thermal peak can be determined using the steady state thermal profile created by the currents induced in the roll. The steady state thermal profile within control zone boundaries for the control zone can have one maxima and two minimums (the minimums are located on opposing sides of the maxima).

Although FIG. 2 illustrate one example of an orientation 200 of an induction heating workcoil with respect to a roll, various changes may be made to FIG. 2. For example, any suitable number of induction heating workcoils could be used with the roll 212. Although FIGS. 3A through 3I illustrate examples of induction heating workcoils, various changes may be made to FIGS. 3A through 3I. For instance, any suitable number of cores and coils could be used in a workcoil. Also, the core(s) could have any suitable size and shape, and the coil(s) could have any suitable number of turns or layers. Further, any other mechanism could be used to cool the workcoils. In addition, features of one or more workcoils shown in FIGS. 3A through 3I could be used in others of the workcoils shown in FIGS. 3A through 3I.

Figure 4:
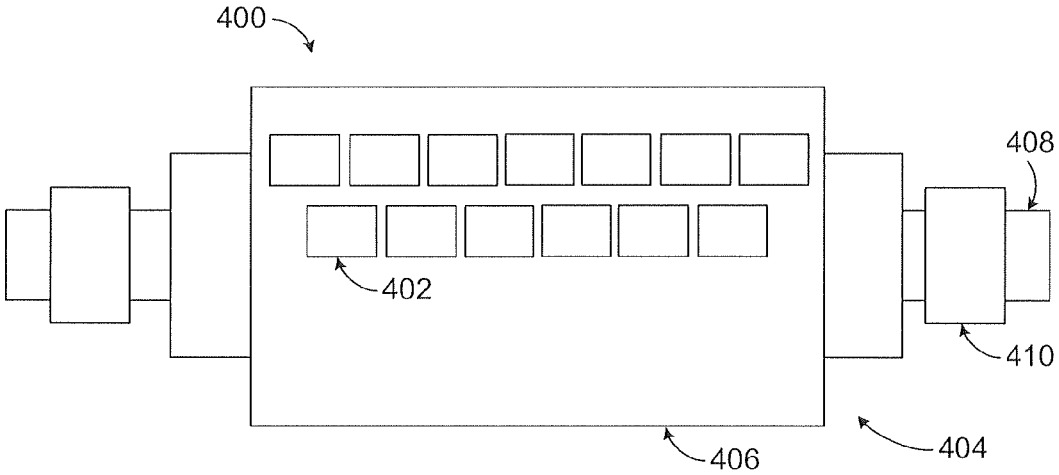
FIG. 4 illustrates an example configuration of induction heating workcoils with respect to a roll according to this disclosure.

FIG. 4 illustrates an example configuration 400 of induction heating workcoils with respect to a roll according to this disclosure. As shown in FIG. 4, the configuration 400 includes multiple induction heating workcoils 402 placed adjacent to each other in an end-to-end fashion across the surface of a roll 404. The induction heating workcoils 402 could have any suitable spacing, such as one induction heating workcoil every fifty millimeters. The configuration 400 also includes multiple rows of induction heating workcoils 402. The induction heating workcoils 402 in the different rows may or may not be offset, and the rows could have any suitable spacing.

The induction heating workcoils 402 operate to produce currents in different areas or zones of a conductive shell 406 of the roll 404. The conductive shell 406 generally represents the portion of the roll 404 that contacts a paper sheet or other product being formed. The conductive shell 406 or the roll 404 could be formed from any suitable material(s), such as a metallic ferromagnetic material. The currents could also be produced in different areas or zones of the roll 404 itself, such as when the roll 404 is solid. The amount of current flowing through the zones could be controlled by adjusting the amount of energy flowing into the coils of the induction heating workcoils 402 (via control of the power sources 210). This control could, for example, be provided by the controller 104 in the paper production system 100 of FIG. 1.

In order to reduce or minimize currents flowing through a shaft 408 and through bearings in a bearing house 410 of the roll 404, the induction heating workcoils 402 represent balanced workcoils, such as those shown in FIGS. 3A through 3I, that individually produce a substantially null flux vector. As a result, a reduced or minimized amount of current flows through the bearings of the roll 404.

Although FIG. 4 illustrates one example of a configuration 400 of induction heating workcoils with respect to a roll, various changes may be made to FIG. 4. For example, the configuration 400 could include any number of rows of induction heating workcoils 402 at any uniform or non-uniform spacing. Also, each row could include any number of induction heating workcoils 402 at any uniform or non-uniform spacing.

Figure 5:
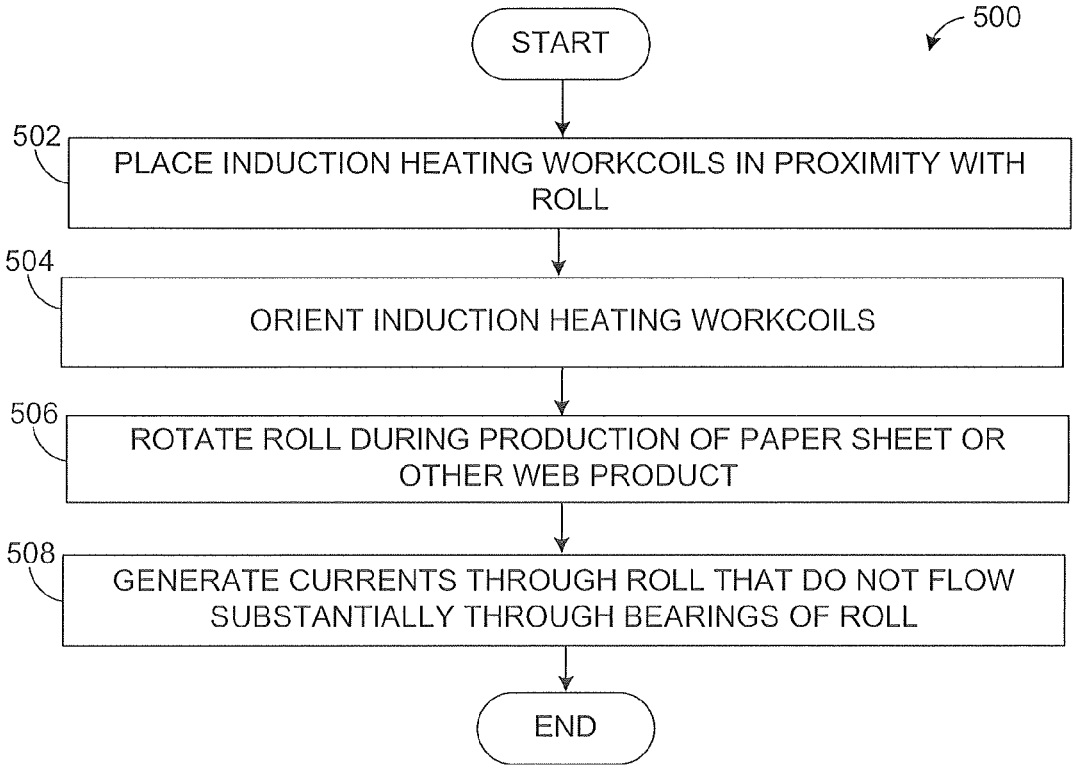
FIG. 5 illustrates an example method for reducing current exiting a roll through its bearings in an induction heating application according to this disclosure.

FIG. 5 illustrates an example method 500 for reducing current exiting a roll through its bearings in an induction heating application according to this disclosure. As shown in FIG. 5, one or more induction heating workcoils are placed in proximity to a roll at step 502. This could include, for example, placing one or multiple induction heating workcoils 202 near a roll in a paper calender. Any suitable number of induction heating workcoils 202 could be placed near the roll.

The induction heating workcoils are oriented at step 504. This could include, for example, orienting the induction heating workcoils 202 so that they provide a desired heating profile for the roll 212. Because the induction heating workcoils 202 are balanced, however, the induction heating workcoils 202 could produce magnetic fluxes that have a substantially null spatial sum in any orientation.

Once installed and oriented, the roll can be rotated during the production of a paper sheet or other continuous web product at step 506, and currents are produced through the roll at step 508. The currents can be generated by providing AC signals to the coils 204 of the induction heating workcoils. Moreover, a reduced or minimized amount of current flows through the bearings of the roll because the induction heating workcoils produce magnetic fluxes with a substantially null spatial sum.

Although FIG. 5 illustrates one example of a method for reducing current exiting a roll through its bearings in an induction heating application, various changes may be made to FIG. 5. For example, while shown as a series of steps, various steps shown in FIG. 5 could overlap, occur in parallel, occur in a different order, or occur multiple times.

It may be advantageous to set forth definitions of certain words and phrases used throughout this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, software, or some combination of at least two of the same. The functionality associated with any particular controller may be centralized or distributed, whether locally or remotely.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising: one or more magnetic cores collectively comprising an inner leg located between two outer legs, the legs coupled to one or more connecting portions; one or more conductive coils wound around the inner leg; a heatsink attached to a surface of the one or more magnetic cores that is opposite the inner leg and the one or more conductive coils, the heatsink configured to release thermal energy generated when the one or more conductive coils are energized;

a thermal shunt attached to the one or more conductive coils to the heatsink, the thermal shunt adjacent to one side of the one or more magnetic cores, the thermal shunt configured to provide thermal energy from at least one of the one or more magnetic cores and the one or more conductive coils to the heatsink; and a plurality of capacitors configured to allow a reduced-size conductor to couple the one or more conductive coils to a power source; wherein the one or more magnetic cores and the one or more conductive coils are configured to generate substantially balanced magnetic fluxes within a roll when the one or more conductive coils are energized; and wherein the one or more magnetic cores and the one or more conductive coils are configured so that heat created by currents induced in the roll by the magnetic fluxes produces a steady state thermal profile on a surface of the roll, the steady state thermal profile having one peak that falls within a control zone associated with the roll.

2. The apparatus of claim 1, wherein substantially all of the magnetic fluxes are generated within the control zone associated with the roll.

3. The apparatus of claim 1, wherein the one or more magnetic cores comprise a single magnetic core, the single magnetic core comprising a single connecting portion coupling the inner and outer legs.

4. The apparatus of claim 1, wherein the one or more magnetic cores comprise two magnetic cores, each magnetic core comprising two legs, the inner leg comprising one leg from a first of the magnetic cores hinged at an end to one leg from a second of the magnetic cores.

5. The apparatus of claim 1, further comprising:

a second coil wound around the one or more conductive coils and configured to cool at least one of: the one or more magnetic cores and the one or more conductive coils.

6. The apparatus of claim 1, further comprising:

a plurality of spring mounts positioned on opposites sides of the heatsink and coupled to the one or more magnetic cores, the spring mounts configured to couple the apparatus to a support structure.

7. The apparatus of claim 4, wherein the hinged legs are surrounded by a single magnetic coil.

8. A system comprising: a roll comprising a conductive material, the roll configured to rotate about an axis; and an induction heating workcoil comprising: one or more magnetic cores collectively comprising an inner leg located between two outer legs, the legs coupled to one or more connecting portions; one or more conductive coils wound around the inner leg; a heatsink attached to a surface of the one or more magnetic cores that is opposite the inner leg and the one or more conductive coils, the heatsink configured to release thermal energy generated when the one or more conductive coils are energized; a thermal shunt attached to the one or more conductive coils to the heatsink, the thermal shunt adjacent to one side of the one or more magnetic cores, the thermal shunt configured to provide thermal energy from at least one of the one or more magnetic cores and the one or more conductive coils to the heatsink; and a plurality of capacitors configured to allow a reduced-size conductor to couple the one or more conductive coils to a power source; wherein the one or more magnetic cores and the one or more conductive coils are configured to generate magnetic fluxes within the roll, wherein the magnetic fluxes travel substantially perpendicular to the axis of the roll, and wherein the magnetic fluxes when spatially summed have a substantially null instantaneous magnetic flux vector.

9. The system of claim 8, wherein the one or more magnetic cores and the one or more conductive coils are configured so that heat created by currents induced in the roll by the magnetic fluxes produces a steady state thermal profile on a surface of the roll, the steady state thermal profile having one peak that falls within a control zone associated with the roll.

10. The system of claim 8, wherein the one or more magnetic cores comprise a single magnetic core, the single magnetic core comprising a single connecting portion coupling the inner and outer legs.

11. The system of claim 8, wherein the one or more magnetic cores comprise two magnetic cores, each magnetic core comprising two legs, the inner leg comprising one leg from each of the magnetic cores.

12. The system of claim 8, further comprising:

a mounting plate on which the workcoil is mounted, the mounting plate comprising curved slots allowing rotation of the workcoil.

13. The system of claim 8, wherein:

the roll comprises one of a set of counter-rotating rolls, the counter-rotating rolls configured to compress a web of material;

an induction heating actuator comprises the induction heating workcoil and the power source coupled to the one or more conductive coils; and the system further comprises a controller configured to control the power source in the actuator to control an amount of compression provided by at least a portion of the counter-rotating rolls.

14. A method comprising: providing an induction heating workcoil having (i) one or more conductive coils wound around an inner leg of one or more magnetic cores, the inner leg located between two outer legs of the one or more magnetic cores; (ii) a heatsink attached to a surface of the one or more magnetic cores that is opposite the inner leg and the one or more conductive coils; (iii) a thermal shunt attached to the one or more conductive coils and to the heatsink such that the thermal shunt is adjacent to one side of the one or more magnetic cores; and (iv) a plurality of capacitors, the capacitors configured to allow a reduced-sized conductor to couple to the one or more conductive coils to a power source; placing the induction heating workcoil in proximity with a roll, generating currents within the roll, the currents collectively having a substantially null instantaneous current vector and flowing substantially parallel to the axis of the roll; releasing, at the heatsink, thermal energy generated when the one or more conductive coils are energized; and providing, by the thermal shunt, thermal energy from at least one of the one or more magnetic cores and the one or more conductive coils to the heatsink.

15. The method of claim 14, wherein heat created by the currents produces a steady state thermal profile on a surface of the roll, the steady state thermal profile having one peak that falls within a control zone associated with the roll.

16. The method of claim 14, wherein the one or more magnetic cores comprise a single magnetic core, the single magnetic core comprising a single connecting portion coupling the inner and outer legs.

17. The method of claim 14, wherein the one or more magnetic cores comprise two magnetic cores, each magnetic core comprising two legs, the inner leg comprising one leg from each of the magnetic cores.

18. The method of claim 14, wherein the induction heating workcoil comprises at least one of:

a reinforcing material around ends of the legs of the one or more cores; and a protective enclosure encasing at least the legs of the one or more cores.

19. The method of claim 14, wherein:

the roll comprises one of a set of counter-rotating rolls, the counter-rotating rolls configured to compress a web of material;

an induction heating actuator comprises the induction heating workcoil and the power source coupled to the one or more conductive coils; and further comprising controlling the power source to control an amount of compression provided by at least a portion of the counter-rotating rolls.

20. The method of claim 19, wherein:

multiple induction heating actuators are associated with multiple zones of at least one of the counter-rotating rolls; and controlling the power source comprises controlling the power source in each actuator to control an amount of compression provided in each zone.

* * * * *